US006494150B1

(12) United States Patent
Phoenix et al.

(10) Patent No.: US 6,494,150 B1
(45) Date of Patent: Dec. 17, 2002

(54) ELEVATING APPARATUS FOR VISUAL DISPLAYS

(75) Inventors: Normand R. Phoenix, Pompano Beach, FL (US); Harvey Altman, Delray Beach, FL (US)

(73) Assignee: Precision Lifts of Deerfield Beach, Incorporated, Deerfield Beach, FL (US)

( * ) Notice: Subject to any disclaimer, the term of this patent is extended or adjusted under 35 U.S.C. 154(b) by 0 days.

(21) Appl. No.: 09/796,403

(22) Filed: Mar. 2, 2001

(51) Int. Cl.[7] ..... A47B 9/00
(52) U.S. Cl. ..... 108/147
(58) Field of Search ..... 108/14.7, 144.11, 108/106; 248/188.4, 188.2

(56) References Cited

U.S. PATENT DOCUMENTS

| | | | | |
|---|---|---|---|---|
| 3,908,565 A | * | 9/1975 | Burnett | 108/147 |
| 3,943,844 A | * | 3/1976 | Standvridge et al. | |
| 4,151,804 A | | 5/1979 | Wache' | |
| 4,400,736 A | | 8/1983 | Weiss | |
| 4,590,865 A | * | 5/1986 | Rutsche et al. | 108/147 X |
| 4,627,364 A | * | 12/1986 | Klein et al. | 108/147 |
| 4,635,565 A | * | 1/1987 | Novak | 108/147 |
| 4,894,600 A | | 1/1990 | Kearney | |
| 5,129,611 A | | 7/1992 | Grover | |
| 5,289,782 A | * | 3/1994 | Rizzi et al. | 108/147 |
| 5,370,063 A | | 12/1994 | Childers | |
| 5,845,590 A | * | 12/1998 | Seidl | 108/147 |
| 6,148,741 A | * | 11/2000 | Motta | 108/147 X |

FOREIGN PATENT DOCUMENTS

DE 1554271 * 5/1969

OTHER PUBLICATIONS

INCA Corporation Catalog 1997 13030 Cerise Ave. Hawthorne, CA.

* cited by examiner

*Primary Examiner*—José V. Chen
(74) *Attorney, Agent, or Firm*—Alvin S. Blum

(57) ABSTRACT

A platform supports a visual display such as a large flat television monitor. An elevating mechanism behind or in front of the display elevates or lowers the platform and the display with a motor. The motor rotates a pair of vertical threaded rods in synchrony. Threaded nuts on the rods raise and lower as the rods rotate. A support bushing sliding on a vertical smooth rod adjacent each threaded rod is connected to the nut to rise and fall with it. The platform is connected at each end to one of the support bushings and extends away from the mechanism to cause the platform and the display thereon to elevate and lower with the nuts under the control of the motor. An alternative embodiment causes the platform to elevate to a height far above the height of the retracted apparatus for concealment in a shorter cabinet.

6 Claims, 4 Drawing Sheets

ELEVATING APPARATUS FOR VISUAL DISPLAYS

FIELD OF THE INVENTION

This invention relates to apparatus for lifting and lowering items, and more particularly for automatic lifting and lowering of visual display apparatus such as television sets, video monitors, and the like.

BACKGROUND OF THE INVENTION

Television sets have become larger over the years. Recently, the television displays, or monitors, have become very large, often separated from the television set. Some are thin but of large area including the new plasma displays. They have become so large that it is often desirable to hide them when not in use. U.S. Pat. No. 4,151,804 issued Jan. 1, 1979 to Wache discloses a device that elevates and lowers a horizontal television support with an electric motor so that the screen may be lowered into a cabinet out of sight when not in use. It employs a threaded bushing riding on a rotating screw for power raising and lowering, and a scissors arrangement to maintain the horizontal position.

Applicant has been marketing a television lift that uses a platform sup ported at opposite sides by a pair of lift assemblies that raise and lower in synchrony. With the new flat plasma displays, it would be desirable to provide a more compact device with simple construction to take advantage of the compact configuration of these new displays. It would be useful to have the lift mechanism behind the display, where it is concealed, instead of on both sides of the display, which requires a wider cabinet.

SUMMARY OF THE INVENTION

It is accordingly an object of the invention to provide a lift that would be simpler, more compact, and that could be located beneath the large displays for concealment. It is another object that the device be able to extend the elevation of its horizontal support platform above its minimum overall height.

A first embodiment of the invention comprises a solitary lift assembly that lies behind or in front of the display. A motor drives a pair of threaded vertical rods mounted on a base in synchrony. A threaded nut on each rod is affixed to a bushing sliding on a smooth vertical rod adjacent each threaded rod. A platform is affixed to both bushings and extends away from the rods to support the display or television set thereon and raise and lower it as desired, while the mechanism is behind or in front of the display.

A second embodiment of the invention comprises a solitary lift assembly on a base that may lie beneath the display. A motor drives a pair of threaded vertical rods in synchrony. A threaded nut on each rod is affixed to a bushing sliding on a first smooth vertical rod adjacent each threaded rod. A vertical bar adjacent each threaded rod is affixed to each bushing. A sprocket atop each bar rotates about a horizontal axle affixed to each bar. A second smooth vertical rod adjacent each bar is provided with a sliding support bushing. A platform is affixed to both support bushings and extends forward of the rods to support the display or television set thereon and raise and lower it as desired. A chain for each sprocket has one end connected to the base, the other end coupled to the support bushing with the chain engaging the sprocket therebetween. As the sprockets are lifted by the action of the threaded rods, the platform rises. It is pulled up by a chain at each end, until it is above the top of the threaded rods.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
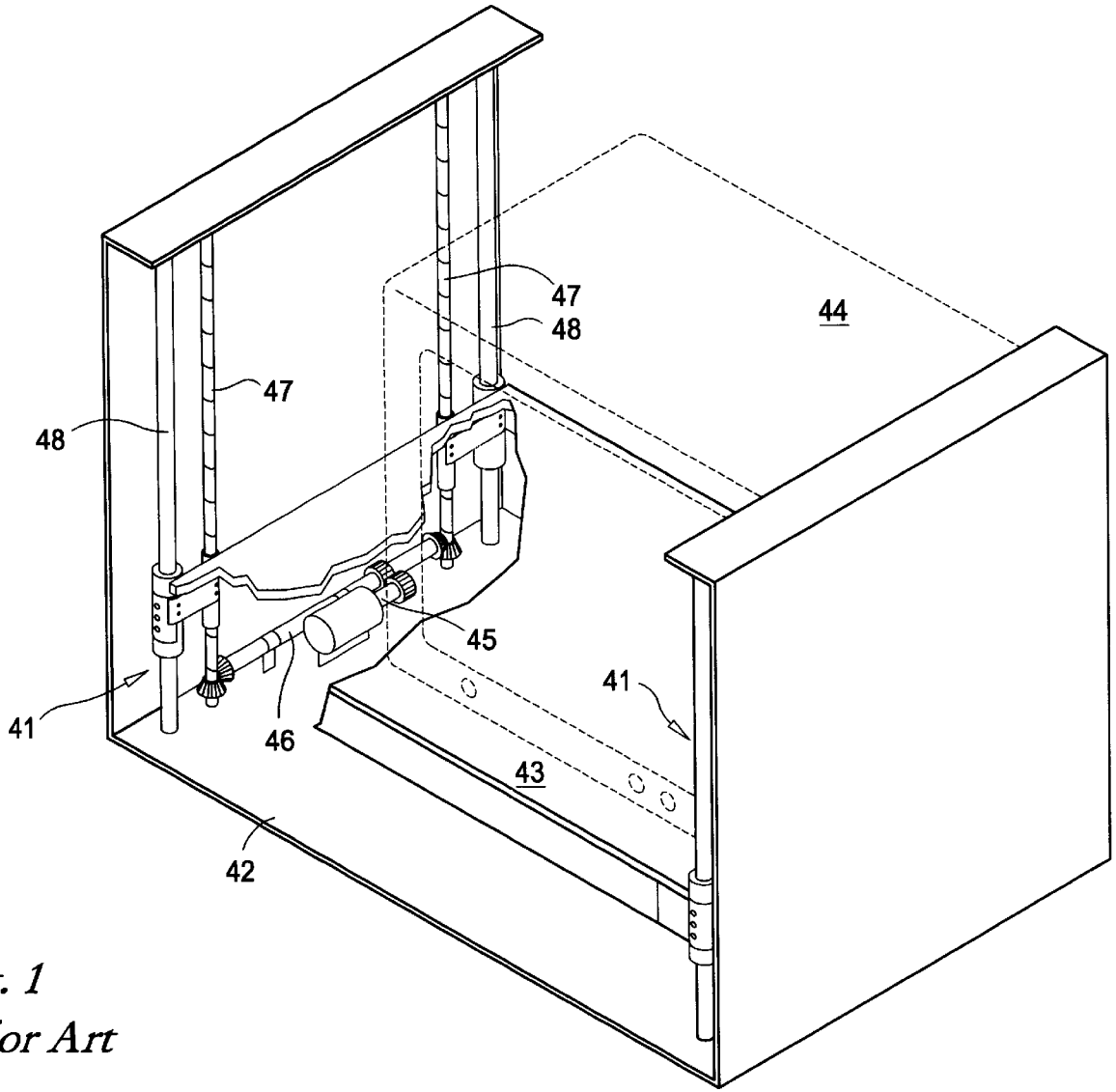
Fig. 1 Prior Art
FIG. 1 is a perspective view of the lift of the prior art.

Referring now to the drawing FIG. 1, applicants' prior art device employed two opposed lift assemblies 41 mounted on a common base 42. They lift a broad platform 43 from both sides to lift a large television set 44 (shown in phantom.). A single motor 45 drives a horizontal drive shaft 46 at the bottom of each lift assembly 41. Each of these is geared to a pair of vertical threaded rods 47. A smooth vertical rod 48 adjacent each threaded rod supports a sliding bushing 49. A threaded nut 50 on each threaded rod is joined to the bushing 49, so that rotation of the rod 47 raises and lowers the nuts and the bushings attached thereto. The platform 43 is attached to the four sliding bushings. It moves up and down with them in response to the motor action. Because the two lift assemblies 41 extend beyond both sides of the set, they require a very wide receptacle or cabinet to conceal the apparatus when not in use. The new plasma displays and other new developments in displays may be quite wide, but they are not as heavy nor as deep as the older television display with their deep CRT's. Applicants' invention enables the lifting of a wide display from a cabinet that is substantially the width of the display. This is because the elevation apparatus is behind or in front of the display. The depth of the display is not great, so there is room behind or in front of the display for the modest depth of the apparatus. The construction enables the display to be lifted from the back or the front only, reducing greatly the complexity of construction and the cost of installation. The platform does not have to be custom fitted to a particular size of display.

Figure 2:
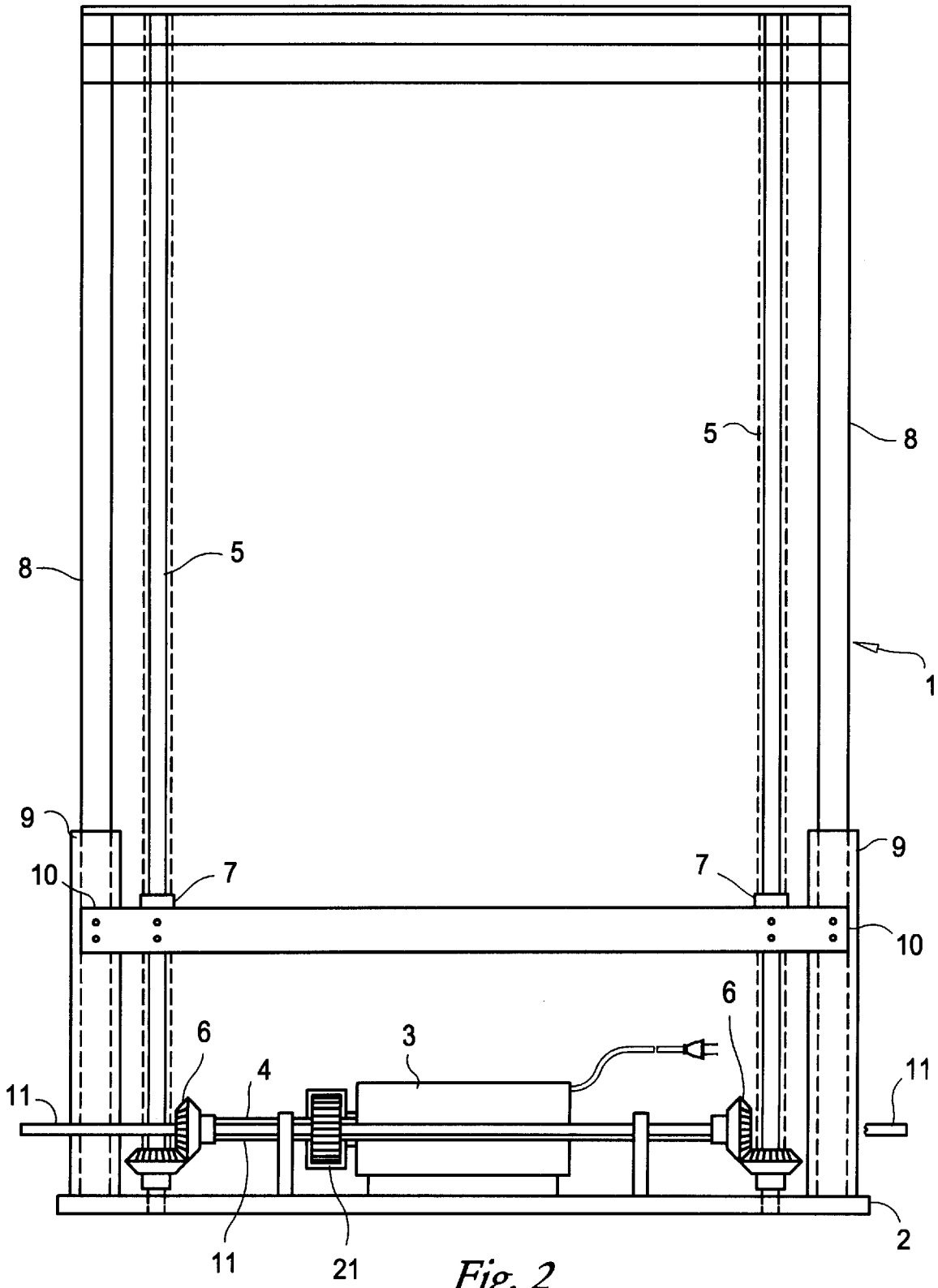
FIG. 2 is a rear elevation view of the elevating apparatus of the invention in lowered condition.

Referring now to the drawing FIG. 2, the elevating apparatus 1 of the invention includes a base 2, upon which is mounted a motor 3, a pair of fixed vertical smooth rods 8, and a pair of pivotally mounted vertical threaded rods 5. A horizontal drive shaft 4 is rotated by motor 3 through gears 21. Gear means 6 connect rods 5 to drive 4 to rotate them in synchrony by motor action. A threaded nut 7 on each threaded rod 5 is connected by a connector 10 to a sliding bushing 9 on each smooth rod 8. As the rod 5 is rotated, nut 7 and bushing 9 raise and lower. A platform 11 (partially broken away) is attached to both bushings 9. It extends away from the assembly to support the display device, and to raise and lower it under motor control. The elevated display lies above the elevation assembly 1, so that it is concealed from view. The structure of the bushings and their length are arranged to overcome the torque applied by the weight of the display on the platform. Applicants' prior art lifts did not encounter great torque, because the platform was supported by lift assemblies on both sides that are visible when the display is elevated.

Figure 3:
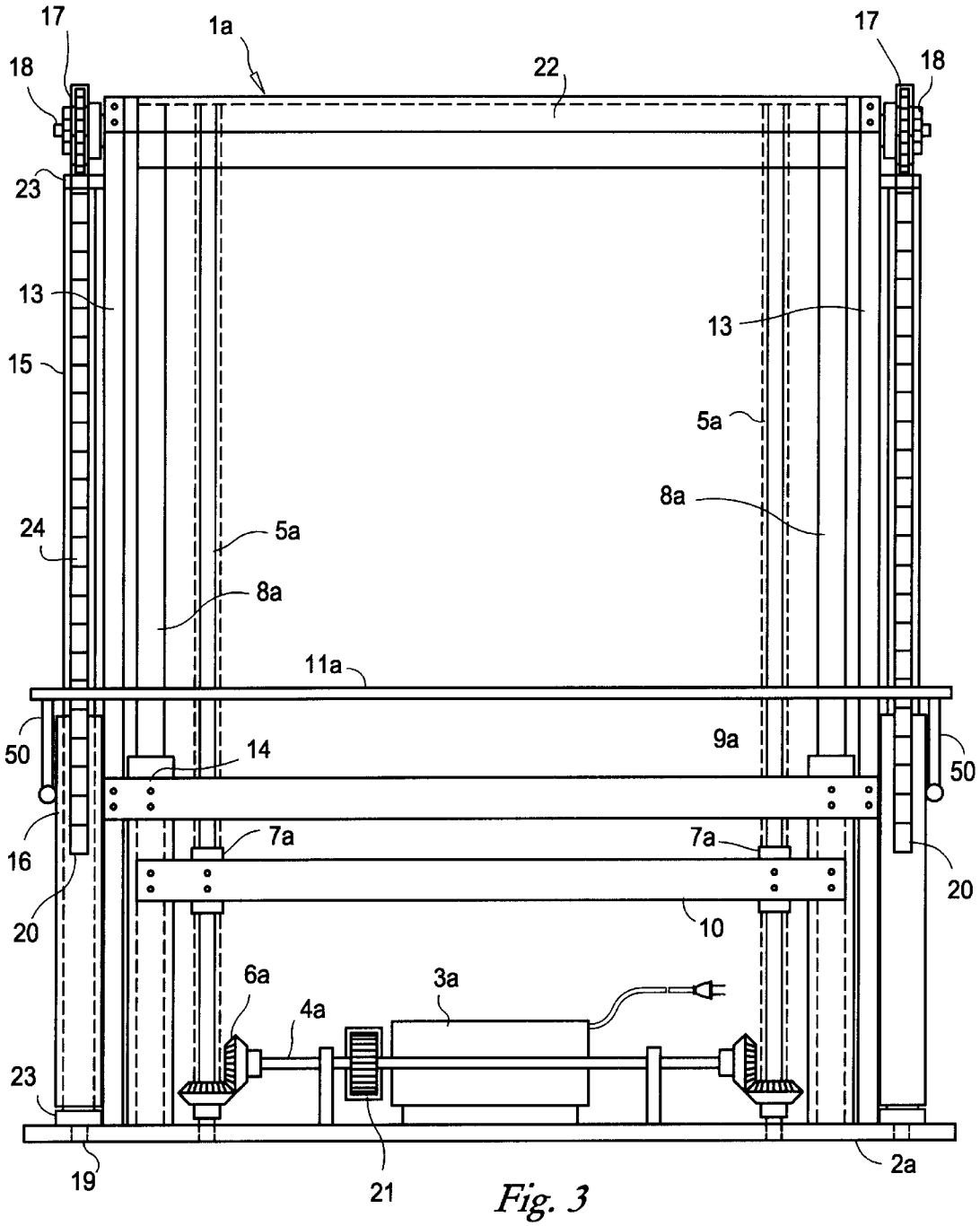
FIG. 3 is a rear elevation view of another embodiment of the invention in lowered condition.
Figure 4:
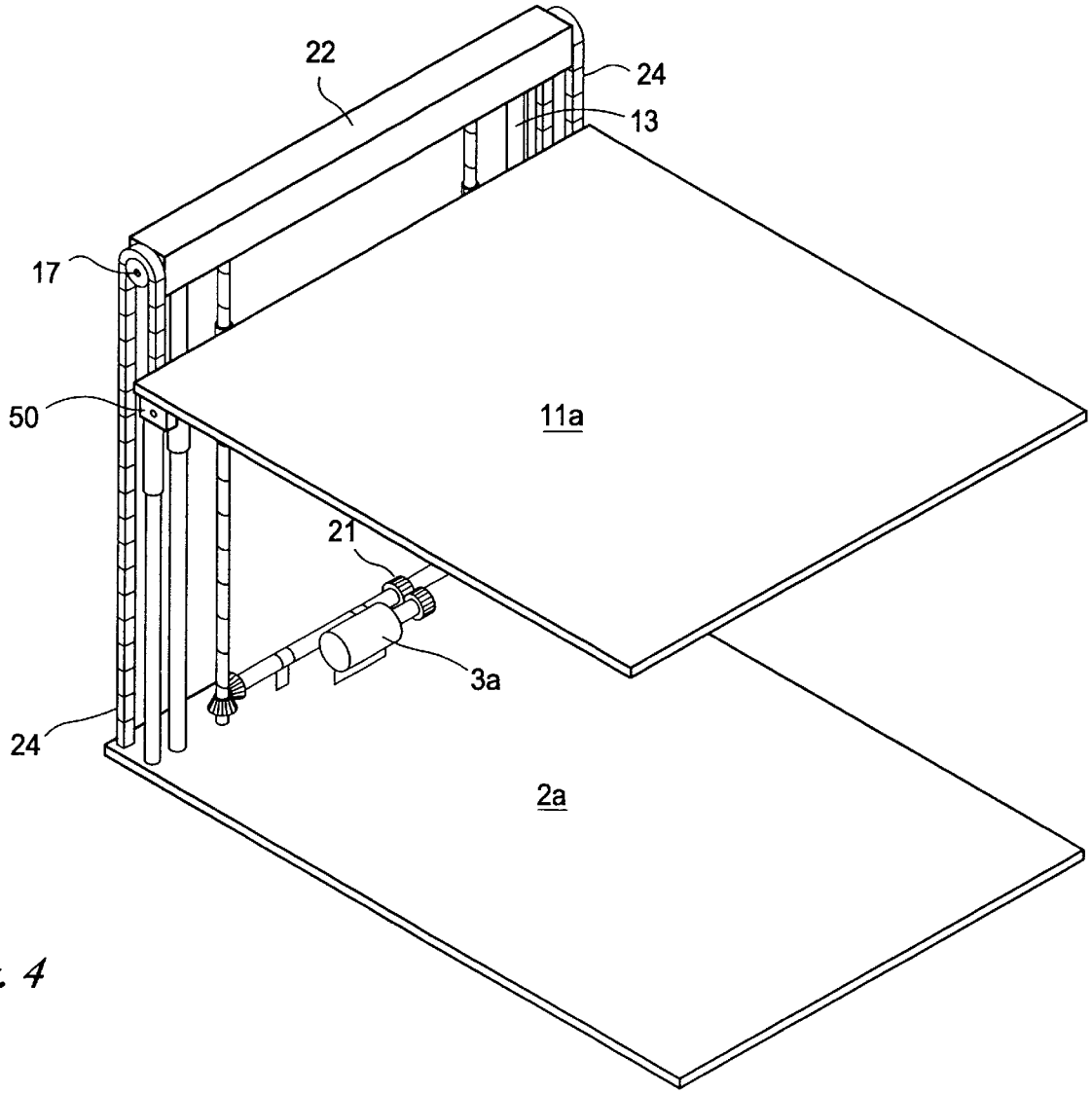
FIG. 4 is a perspective view of apparatus of FIG. 3 in partially elevated condition.

Referring now to the drawing FIGS. 3 and 4, another embodiment 1*a* of the invention is shown that has the unique property of extending the platform far above the height of the retracted apparatus so that the display may be stored in a shorter cabinet. A base 2*a* supports a motor 3*a,* a horizontal drive shaft 4*a,* two elongate vertical rods 8*a,* and two rotatably mounted elongate threaded rods 5*a*. Gears 21*a* couple rotation of the motor to drive 4*a*. Gears 6*a* couple the drive to rotate the threaded rods in synchrony. A threaded nut 7*a* on each threaded rod 5*a* is connected to a sliding bushing 9*a* on each smooth rod 8*a* by a connector 10. A vertical bar 13 adjacent each smooth rod is attached to the sliding bushing 9*a* by connector 14. The two bars 13 are joined at their upper ends by connector 22. An elongate smooth support rod 15 is attached at top and bottom by connectors 23 to bar 13. As the motor turns, threaded rods 5*a* rotate, causing nuts 7*a* to raise or lower. Bushing 9*a,* bar 13, and support rod 15 raise and lower together with the nut. An axle 18 extends horizontally from the top of each bar. A sprocket 17 is rotatably mounted on each axle and raises and lowers along with the bar. A chain 24 is attached to the base at a first end 19, and at a second end 20 to a support bushing 16 that slides on the support rod 15. A platform 11*a* extends outwardly sufficiently to fully support the display device. The platform is attached to the support bushings 16 by brackets 50. As the support rod 15 and sprocket 17 move vertically by a distance D, support bushing 16 and platform 11 a attached thereto will move a distance 2D. By this mechanism, the uppermost position of the platform will be well above the top of the threaded rods and other vertically fixed elements. Consequently, at the lowermost condition the device may be concealed in a much shorter cabinet.

While we have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An elevating apparatus for visible displays which is movable in height through the action of a motor, so as to elevate the display to a desired height for its use, as well as to lower the same to a position where the display may be concealed when not in use, the improvement comprising:

a) a base;

b) a motor mounted on the base;

c) an elongate horizontal drive coupled to the motor for rotating the drive about its long axis;

d) a pair of spaced-apart elongate vertical threaded rods upstanding from the base;

e) gear means operatively coupling the horizontal drive to each of the threaded rods to rotate them in synchrony;

f) a threaded nut mounted on each threaded rod;

g) a vertical smooth rod adjacent each threaded rod;

h) an elongate slide bushing mounted on each smooth rod for sliding motion thereon;

i) each threaded nut connected to the elongate slide bushing adjacent thereto for causing the slide bushings to raise and lower as the threaded rods are rotated in one direction or the other by the motor action; and j) a horizontal display-supporting platform having a front side and a rear side, the platform operatively connected to the slide bushings on the rear side thereof so that the platform is raised and lowered in response to rotation of the motor, the rods and bushings all being behind the platform on the rear side thereof to minimize the width of the apparatus.

2. The elevating apparatus according to claim 1 in which the platform and the slide bushings are attached to one another so as to cause them to move vertically at the same rate.

3. The elevating apparatus according to claim 1 in which the platform is connected to the slide bushings by a chain and sprocket mechanism so as to move the platform vertically at a greater rate than the slide bushings and to extend the platform above the threaded rods.

4. An elevating apparatus for visible displays which is movable in height through the action of a motor, so as to elevate the display to a desired height for its use, as well as to lower the same to a position where the display may be concealed when not in use, the improvement comprising:

a) a base;

b) a motor mounted on the base, c) an elongate horizontal drive coupled to the motor for rotating the drive about its long axis;

d) a pair of spaced-apart elongate vertical threaded rods upstanding from the base;

e) gear means operatively coupling the horizontal drive to each of the threaded rods to rotate them in synchrony;

f) a threaded nut mounted on each threaded rod;

g) a vertical smooth rod adjacent each threaded rod;

h) an elongate slide bushing mounted on each smooth rod for sliding motion thereon;

i) each threaded nut attached to the elongate slide bushing adjacent thereto for causing the slide bushings to raise and lower at the same rate as the threaded nuts as the threaded rods are rotated in one direction or the other by the motor action; and j) a horizontal display-supporting platform having a front side and a rear side, the platform connected to the slide bushings on the rear side thereof so that the platform is raised and lowered by the motor action at the same rate as the slide bushings, the rods and bushings all being behind the platform on the rear side thereof to minimize the width of the apparatus.

5. An elevating apparatus for visible displays which is movable in height through the action of a motor, so as to elevate the display to a desired height for its use, as well as to lower the same to a position where the display may be concealed when not in use, the improvement comprising:

a) a base;

b) a motor mounted on the base;

c) an elongate horizontal drive coupled to the motor for rotating the drive about its long axis;

d) a pair of spaced-apart elongate vertical threaded rods upstanding from the base;

e) gear means operatively coupling the horizontal drive to each of the threaded rods to rotate them in synchrony;

f) a threaded nut mounted on each threaded rod;

g) a vertical smooth rod adjacent each threaded rod;

h) an elongate slide bushing mounted on each smooth rod for sliding motion thereon;

i) each threaded nut connected to the elongate slide bushing adjacent thereto for causing the slide bushings to raise and lower as the threaded rods are rotated in one direction or the other by the motor action;

j) a vertical bar attached to each slide bushing;

k) a vertical support rod attached to each bar;

l) a support bushing slidably mounted on each support rod;

m) a sprocket rotatably mounted on a horizontal axle attached to each bar at an upper end thereof;

n) a chain having a first end attached to the base, a second end attached to the support bushing and the chain engaging the sprocket therebetween to cause the support bushing to move at the rate of the threaded bushing plus the rate of the sprocket;

o) a horizontal display-supporting platform having a front side and a rear side, the platform attached to the support bushings on a rear side thereof, whereby the platform rises at a greater rate than each slide bushing and extends to a greater elevation than the threaded rods, the rods and bushings all being behind the platform on the rear side thereof to minimize the width of the apparatus.

6. The apparatus according to claim 5 in which the platform moves at twice the speed of each slide bushing.

* * * * *